US005779511A

United States Patent [19]

Davidson, Jr.

[11] Patent Number: 5,779,511

[45] Date of Patent: Jul. 14, 1998

[54] OVERBOARD RECOVERY DEVICE AND RESCUE IDENTIFYING SIGNAL

[76] Inventor: Robert M. Davidson, Jr., 58 S. Gate La., Southport, Conn. 06490

[21] Appl. No.: 695,884

[22] Filed: Aug. 12, 1996

[51] Int. Cl.[6] ..... B63C 9/00

[52] U.S. Cl. ..... 441/80; 441/83

[58] Field of Search ..... 441/80, 83

[56] References Cited

FOREIGN PATENT DOCUMENTS 8803495 5/1988 WIPO ..... 441/80

OTHER PUBLICATIONS

*Yachting Monthly*, Mar. 1996, pp. 50–53.

*Tri Buckle Brouchure*, 4 pages, Date—applicant believes that the brochure was made available in England sometime in Oct. 1995.

*Primary Examiner*—Jesus D. Sotelo

*Attorney, Agent, or Firm*—Perman & Green, LLP

[57] ABSTRACT

A man overboard rescue device comprises a sheet-like lifting harness having an effective shape as defined by a top, a first foot and a second foot with each of the top. Each of the first foot and the second foot including means for securing each foot to a stationary part of a vessel. The top of the lifting harness including means for connecting the lifting harness to a halyard for moving the lifting harness top relative to the first foot and the second foot. The lifting harness in an area associated with the top thereof being formed at least in part from a mesh-like material which is capable of passing substantially freely through water.

12 Claims, 6 Drawing Sheets

OVERBOARD RECOVERY DEVICE AND RESCUE IDENTIFYING SIGNAL

BACKGROUND OF THE INVENTION

The present invention relates to a man overboard pick-up device, and relates more particularly to a device which can be quickly deployed from a stored condition on deck of a marine vessel to a person who is in the water requiring the assistance of the vessel in order to rapidly effect the removal or recovery of the person from the water and onto the vessel.

The need to provide a mechanism for retrieving an individual who has fallen overboard or an individual found in the water requiring help and for putting that person on board a vessel has long been known to sailors. With this comes the need to hoist the individual above the free board of a vessel which often times may involve hoisting the individual several feet above the water line.

In the past, with sailing vessels, it was known to use a tri-sail, such as a genoa sail, to do such a task. Specifically, one would release the halyard so that the head of the sail could be dipped into the water and pick up could be made. The individual who was being picked up could be placed within the partially submerged sail and hoisted above board. Problems with this method existed and the method could not be relied on. First, the operation involved use of a sail. The material of a sail did not permit the free flow of water therethrough. Rather, when placed in the water for the purpose of catching a man over board in a net-like manner, the sail could not easily move through the water. Also the handler was thus moving the weight of the water which was being pushed and absorbed by the sail in addition to the weight of the person being hoisted, if capture was even possible. Additionally, this procedure did not lend itself to quick deployment while the vessel was enroute to the person in need because the sail was usually needed to propel the boat to the individual in the water required immediate assistance onto the safe platform of the deck of a vessel. Additionally, once the rescued individual is brought on board the vessel, it is usually helpful, if not necessary, to have some form of indicator flying from the mast showing that the vessel has on board an individual in need of assistance. This would, for example, be very helpful for an aerial rescue effort involving, a helicopter, or any ship which is trying to single out the one vessel from others which had radioed for help when sailing.

Accordingly it is an object of the invention to provide a man overboard rescue device of the aforementioned type wherein the device is capable of being easily stowed for ready deployment on the deck of a vessel without taking up much deck space or requiring extensive mechanical implementation.

Another object of the invention is to provide a man overboard rescue device of the aforementioned type wherein the device is made from a fabric which moves through the water with little, if any, resistance.

Still a further object of the invention is to provide a man overboard rescue device of the aforementioned type wherein a material which is responsible for hoisting the rescued person also includes indicia for indicating the need for help.

Still a further object of the invention is to provide a man overboard rescue device of the aforementioned type which is formed from material that is readily discernible against the background of the open ocean.

Yet still a further object of the invention is to provide to provide a man overboard rescue device of the aforementioned type which can be used by a single user to effect recovery of an individual at sea.

SUMMARY OF THE INVENTION

A man overboard rescue device comprises a sheet-like lifting harness having an effective shape as defined by a top, a first foot and a second foot with each of the top, the first foot and second foot including a means for securing the lifting harness to a vessel. The top of the lifting harness including means for connecting the lifting harness to a halyard for moving the lifting harness top relative to the first foot and the second foot. The lifting harness in an area associated with the top thereof being formed at least in part from a mesh-like material which is capable of passing substantially freely through water.

Ideally the lifting harness is formed from a two-piece construction with a first section associated with the top thereof and a second section associated with the first foot and the second foot, with the first section including the mesh-like water permeable material and the second section being formed from a generally water impermeable material.

Desirably, the lifting harness is provided with an eyelet at each of the top and the first foot and the second foot and surrounding each of the eyelets are radially extending stress dispersing strips which are secured to the material making up the lifting harness.

In the preferred embodiment, the top section includes indicia which is printed thereon and sized relative to the lifting harness overall length dimension with a proportion of at least 1:4, and the first section of the harness being defined by a material which has a fluorescent orange color and the indicia includes black lettering which is screen printed thereon.

Preferably, a swivel means is associated with each first foot and second foot, and the harness having a lower edge extending in a straight line therebetween and each swivel means including a swivel snap-clip having an axis of rotation and each capable of being secured to one of two space points on the deck of a vessel for effecting rotation of the lower edge of the lifting harness about the axis of rotation of each snap-clip so as to roll the lifting harness in a roll form for storage. Adjustable straps are interposed between respective ones of the forward foot and aft foot and each swivel means, and securement straps which wrap around the lifting harness in roll form having VELCRO connectors thereon and the first foot and second foot of the lifting harness are secured at two points on a vessel through the intermediary of the swivel means, and the two point having a free space therebetween.

Ideally a C-shaped roll clip is provided and is clipped onto the lifting harness substantially along the length of the lower edge. The clip has a generally hollow interior confine which communicates exteriorly through a slot-like passage defined by opposed side faces, and the material making up the clip being semi-rigid thereby making the opposed side faces capable of being resiliently spread apart to allow passage of the lower edge therethrough and into the larger volume confine.

The invention also resides in sheet like lifting harness comprised of two geometric sections attached together along a line transversely extending across the lifting harness to define generally a base section having a first foot and a second foot and an upper section having a top. The base section being formed from a non-water permeable material and the upper section being formed from a mesh-like material. The lifting harness also includes a border which is attached thereabout. The top of the lifting harness, the forward foot and aft foot each have an eyelet defined by a ring associated therewith and being provided with webbing which are provided as reinforcing strips which prevent pullout of each ring secured to the lifting harness. The top section including indicia which is printed thereon and sized relative to the lifting harness overall length dimension to be readily viewable and the first section of the harness further being defined by a material which is has a fluorescent orange color and the indicia includes black lettering which is printed thereon.

The invention still further resides in a method of bringing aboard a person who is the water onto a vessel comprising the steps of providing a lifting harness having a generally triangular shape as defined by a top portion and two foot portions and providing each of the foot portions with a means for securing the harness to a stationary part of a vessel. The method further includes providing means for securing the top portion to a halyard for moving the harness relative to the remaining first and second foot portions. The top portion is provided with a mesh-like material which is capable of passing freely through water. Using the top portion of the lifting harness to surround the person in the water as the person is oriented alongside the vessel and pulling the person upwardly by pulling down on a halyard to roll the person over on him or herself as the halyard is pulled upwardly.

DETAILED DESCRIPTION OF THE PREFERRED EMBODIMENT

Figure 1:
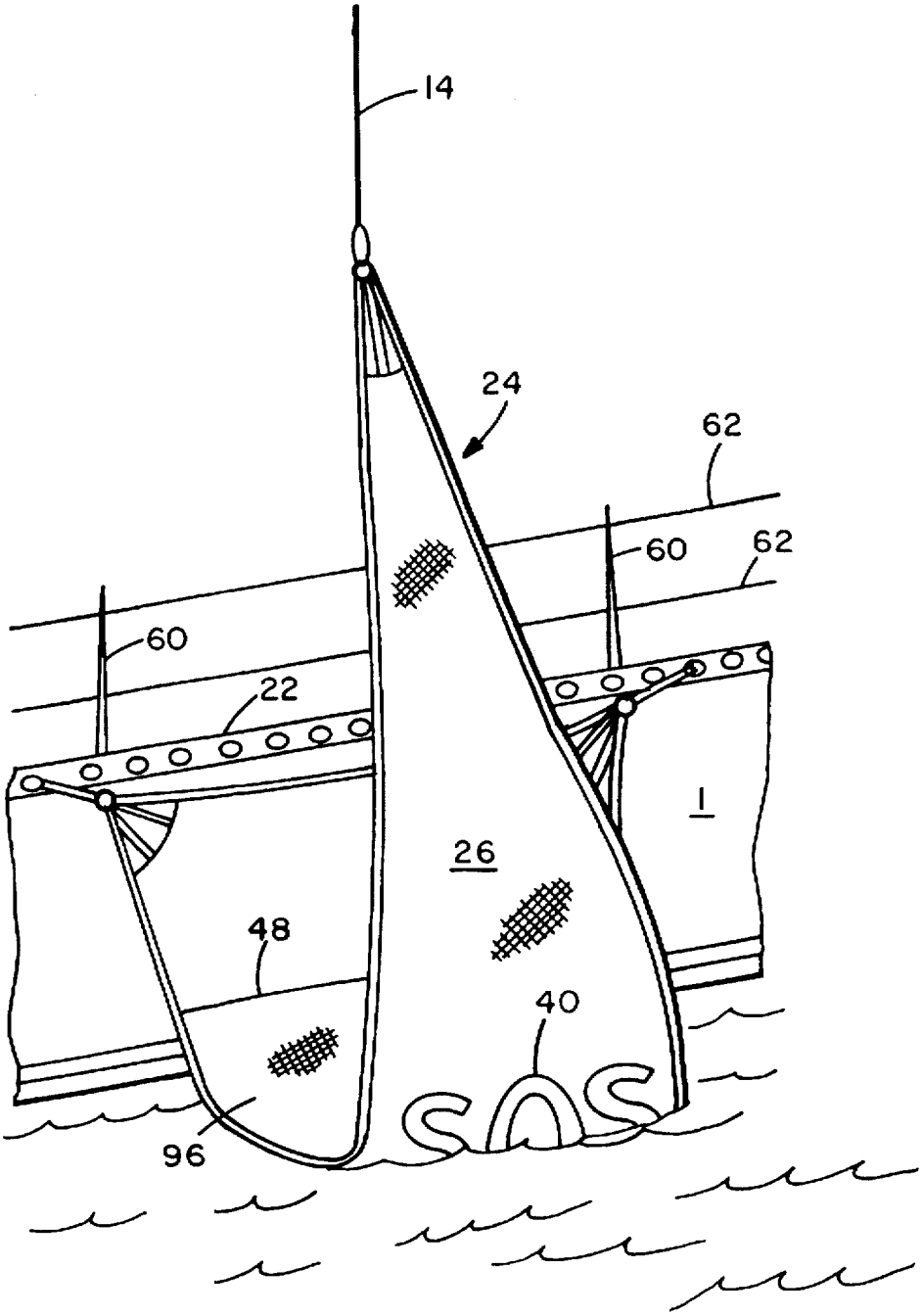
FIG. 1 is a partially fragmentary view illustrating the man overboard rescue device in its deployed condition.
Figure 2:
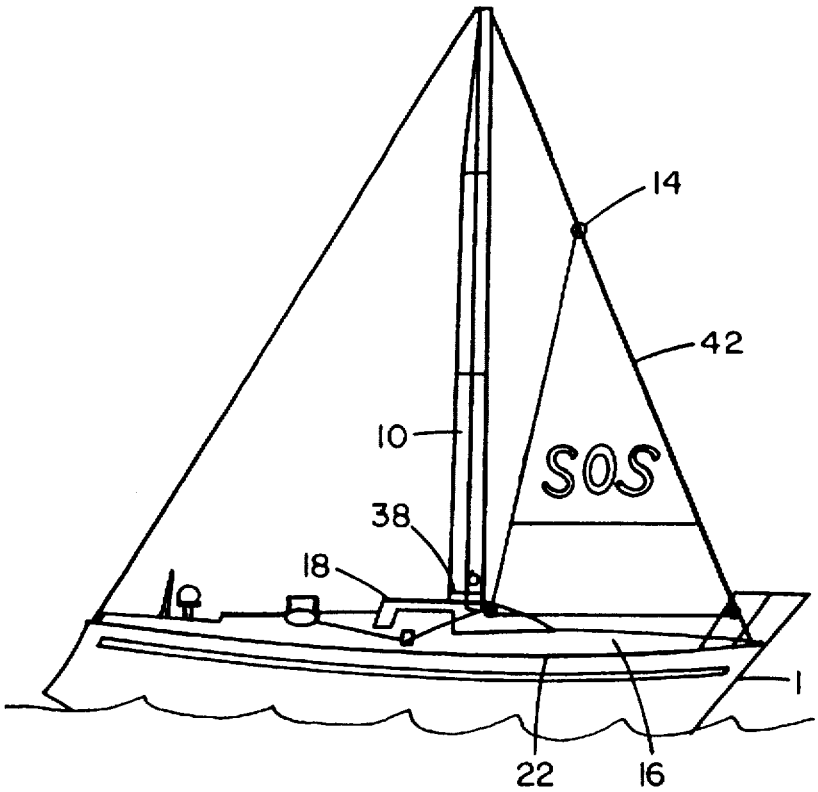
FIG. 2 is a drawing illustrating the man overboard rescue device of the present invention as it is deployed on a sailing vessel in a hoisted condition using a halyard.

FIGS. 1 and 2 illustrate a sailing vessel 1 of a conventional kind. The vessel includes a main mast 10, and at least one sail which is connected to the main mast through a halyard 14. The halyard, as is known, moves through a pulley at the top of the mast and is directed downwards toward the deck the vessel where it connects to a winch responsible for pulling the sail vertically towards the top of the mast. The vessel at its top surface defines a deck 16 which separates along two sides of a cabin 18 to define walkways 22.

As shown in FIG. 1, the device indicated generally at 24 embodies the present invention. The device 24 includes a sheet-like lifting harness 26 which is adapted for connection and deployment along either the port or starboard sides of the vessel 1. The lifting harness has a generally triangular configuration which renders it well suited for such connection and deployment, and is formed generally primarily from a mesh-like material which allows it to move easily through water when it is so deployed overboard.

Figure 4:
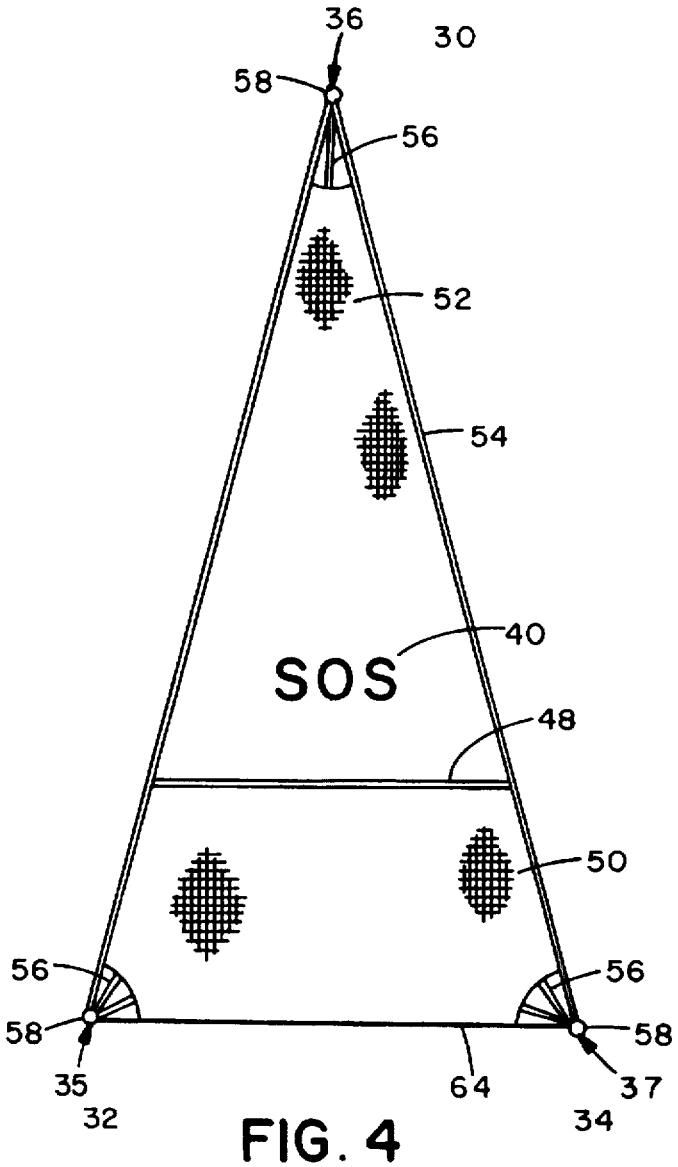
FIG. 4 is a plan view of the lifting harness embodying the present invention.

Referring now to FIG. 4 and to the general configuration of the lifting harness, it should be seen that the lifting harness 26 has a top 30, an aft foot 32 and a forward foot 34, each of which aft and forward foots are adapted to be anchored to the deck along one of the port and starboard walkways. The top 30 of the lifting harness has an eyelet 36 which is correspondingly shaped and sized to receive a locking hook disposed at one end of the halyard 14. Each aft foot 32 and forward foot 34 also has an eyelet 35 and 37, respectively, which secures the base of the harness to the vessel. In this way, the lifting harness 26 at the top 30 thereof can be lifted upwards by a direct connection with the halyard 14 for purposes of hoisting a person on board the vessel while the aft foot and forward foot are each secured against movement to the vessel through various connections to hoist a person out of the water in accordance with one aspect of the invention.

Figure 3:
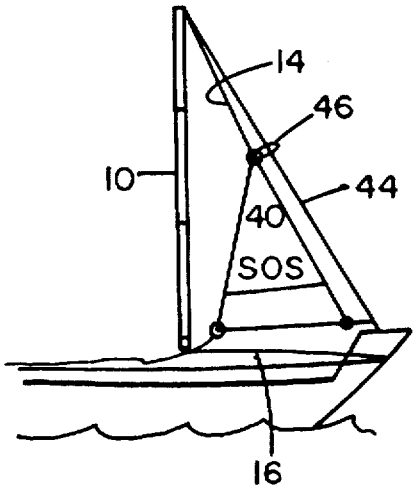
FIG. 3 is a schematic view of an alternative embodiment of the man overboard rescue device of the present invention as it is deployed on a sailing vessel in a hoisted condition using a headstay strap.
Figure 3A:
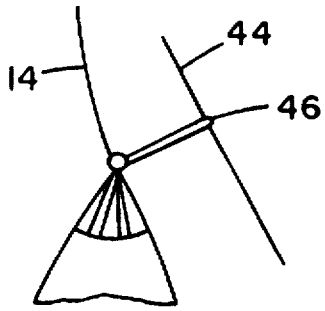
FIG. 3*a* is a detailed view of the headstay strap connection.

As seen in FIGS. 2, 3, and 3*a*, a further aspect of the invention is provided by the lifting harness 26 in a post rescue mode as a signaling device to indicate to others that help is needed or that the vessel is carrying a person in need of medical attention. As seen in the figures, the lifting harness 26 has screen printed on it in black indicia 40 which is of a size sufficient to read by passing vessels from a distance. This size is found visibly adequate when the height of the lettering is about ⅓ the overall length of the lifting harness.

In the preferred embodiment, the indicia 40 bears the emergency signifying letters, SOS, or the symbols of the international distress signal. In the indicia displaying mode, the top 30 of the lifting harness 26 is hoisted upwards by the halyard 14 to a point where the harness is almost completely vertically disposed and held down in this disposition by the forward foot 34 and the aft foot 32 which in the illustrated embodiment are secured to the vessel in a different way than used in the person hoisting mode. The connection between the aft foot 32 and the vessel 1 in this mode can be accomplished by clewing the aft foot 32 through the eyelet 35 to a line 38 which is secured at its other end about a winch. Securement of the forward foot 34 may be accomplished by connecting the forward foot to the bow pulpit using the eyelet 37 and a standard buckle.

Connection between the top 30 of the lifting harness 26 and the vessel can take two alternative forms. One is illustrated in FIG. 2, wherein the halyard 14 is used to directly pull the leading edge 42 of the lifting harness 26 in line with the headsail track of the vessel. Alternatively, as illustrated in FIGS. 3 and 3*a*, the lifting harness 26 may be attached to the headstay 44 of the vessel through the intermediary of a strap 46 which is disposed through the eyelet 36 and around the headstay 44 for the purpose of using the headstay as a track along which the top 30 of the harness can be pulled by the halyard 14 which connects through the eyelet 36.

As illustrated in FIG. 4, it should be seen that the lifting harness 26 is formed generally from two geometric sections which are sewed together along the transversely extending line 48 to define generally a base portion 50 and an upper portion 52. The base portion 50 is formed from a non-water permeable material, such as, nylon cloth, whereas the upper portion 52, which is introduced into the water, is formed from a mesh like material which is ideally suited for passing through the water without significant resistance. The lifting harness also includes a border 54 which can be sewn and/or adhesively attached thereabout. Also, at the top of the lifting harness, and at the forward foot and aft foot is provided webbing 56 which are provided as reinforcing strips which prevent pullout of the eyelets 35, 36 and 37 which are secured to the lifting harness 26 by passing each webbing strip through a ring 58, i.e. eyelet, and thereafter securing each webbing strip to opposite sides of the harness material. In the case of the forward foot 34 and the aft foot 32 a number of radially extending webbing strips may be disposed in a radial fashion to enhance reinforcement of the rings. The following table is a listing of the particulars of the elements which make up the lifting harness:

| Reference Number | Description |
|---|---|
| 50 | Nylon Cloth - 430 denier × 430 denier, ¾ oz. coated with urethane. Fluorescent orange color. |
| 52 | Sleeveknit - 9 × 9 knitted polyester mesh with vinyl coating. 6.5 oz. per square yard. |
| 54 | Dacron Tape - 6 oz. dacron weight, 3" wide. |
| 56 | Nylon Tubular Webbing |
| 58 | Stainless Steel Rings |

Figure 5:
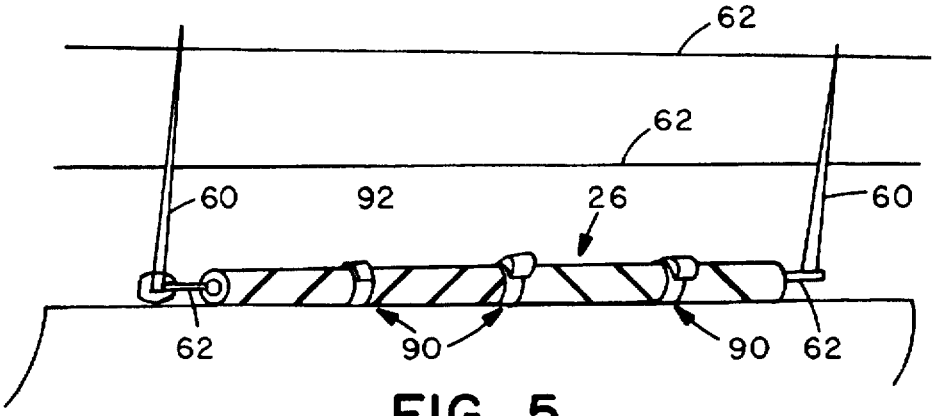
FIG. 5 is a schematic view showing the man overboard rescue device in its stored rolled up condition aboard the deck of a sailing vessel.

As illustrated in FIG. 5, the lifting harness may be stored for use in the case of a possible emergency situation for deployment along either of the port and starboard side walkways 22 and secured therein between stanchions 60,60 which support lifelines 62,62 about the vessel forming a railing about the deck. The forward foot 34 and the rear foot 32 are each secured to a respective one of consecutively ordered ones of the stanchions 60,60 so as to dispose the lower edge 64 of the harness in a generally parallel relationship with the length of the vessel 1.

In FIG. 5, it should be seen that the lifting harness 26 can be stored in a rolled condition for quick deployment in the event that is needed. For this purpose, the lifting harness is storable in the illustrated rolled condition and is secured at its ends to the stanchions 60,60 of the railing through the intermediary of swivel means 62, 62.

Figure 6:
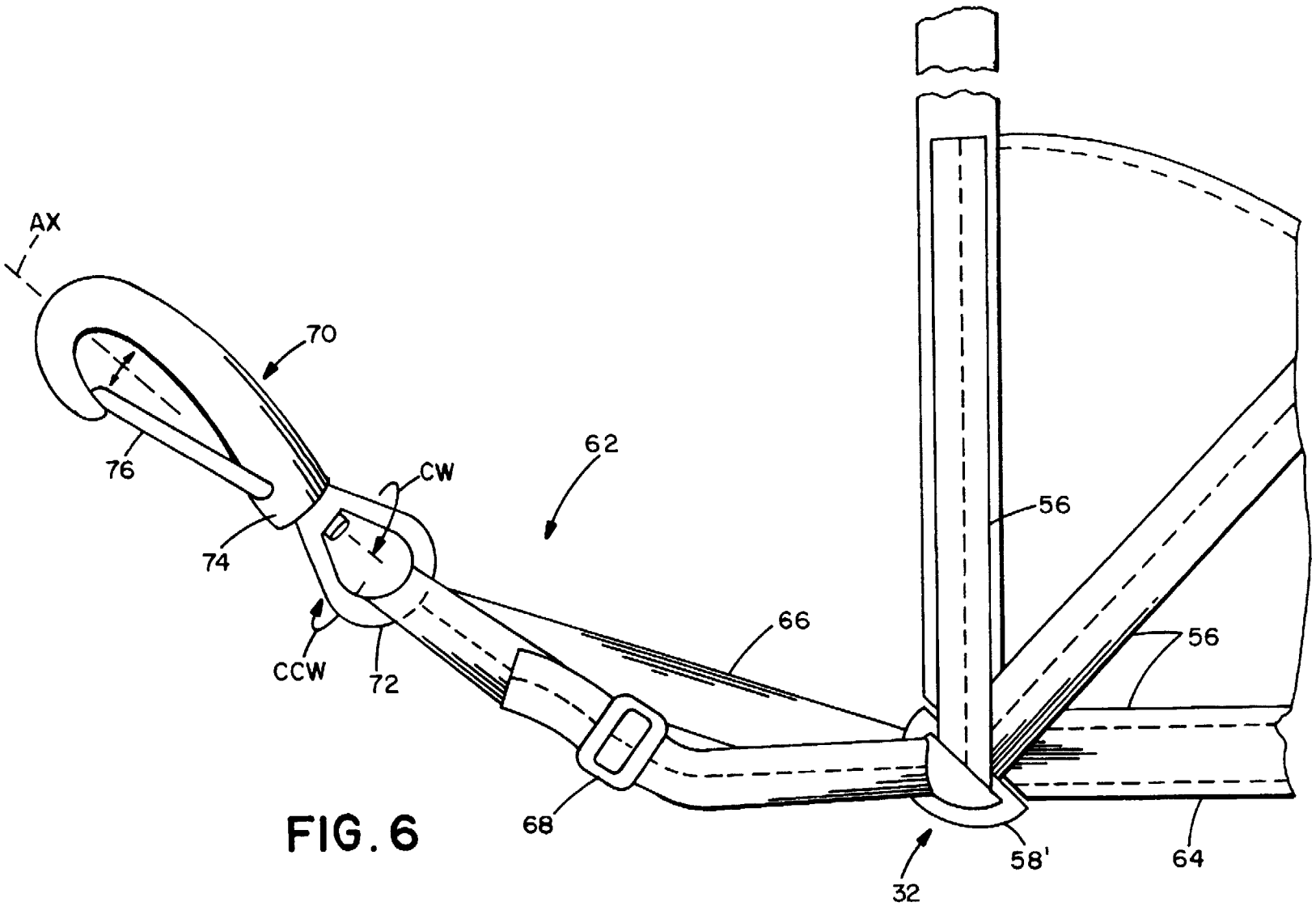
FIG. 6 is a partially fragmentary view of a lower or bottom edge corner of the lifting harness with the roll-up feature.
Figure 7:
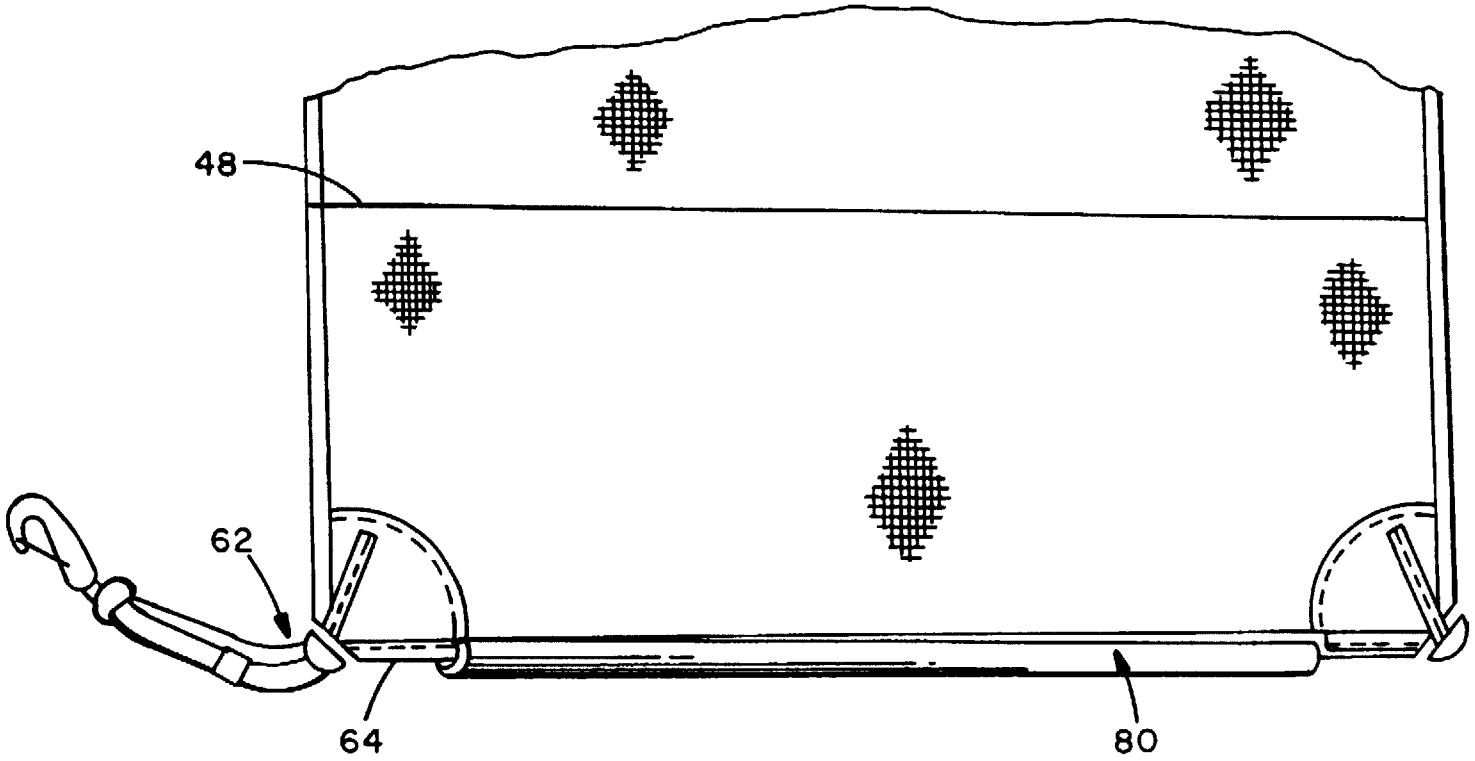
FIG. 7 is a partially fragmentary view of the lifting harness with a roll-up clip disposed therealong.
Figure 8:
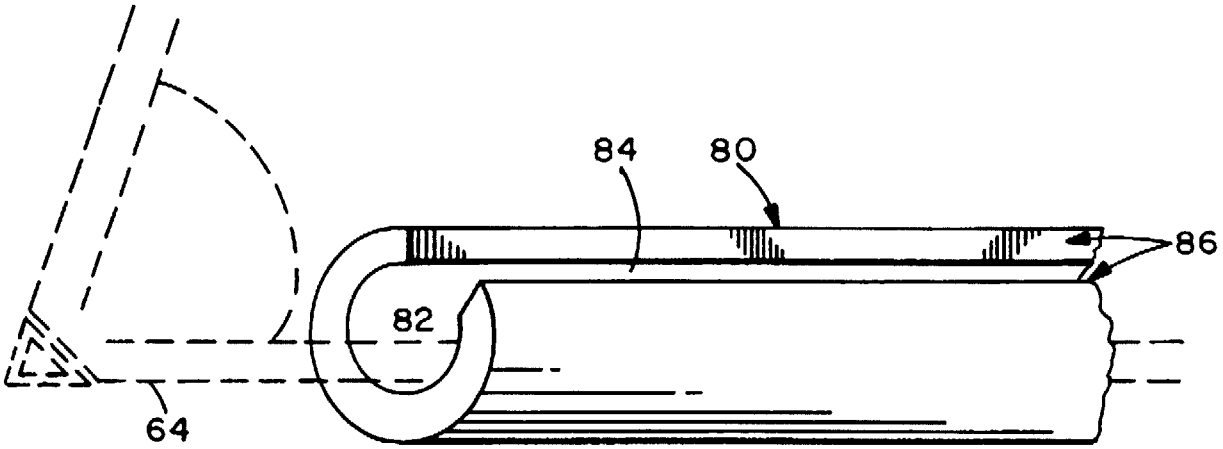
FIG. 8 is a partially fragmentary perspective view of the roll clip shown in FIG. 7.

As illustrated in FIG. 6, each swivel means 62,62 is comprised of an adjustable strap loop 66 having a length adjustment buckle or slider 68 and a commercially available swivel snap-clip 70 defined by a base portion 72 through which the strap 66 is passed and a snap clip portion 74 having a pivotable locking arm 76 which is spring biased in the illustrated closed condition, and which snap clip portion being rotatable relative to the base portion in either a clockwise CW or a counterclockwise CCW direction in full 360 rotation about the axis AX. In this way, each swivel means 62 provides a means for maintaining the lower edge 64 of the harness in a taut condition while nevertheless allowing the harness to be rolled about the lower edge 64 in the manner illustrated in FIG. 5. Alternatively, it should be understood that the base 72 of the swivel can be attached directly to either of the forward and aft foots in substitution for the associated ring 58 thereby simplifying the construction.

To aid in rolling of the harness about the lower edge 64 and keeping it in the rolled generally tubular condition even when not pulled axially tautly at its ends when connected to the two consecutively ordered stanchions 60,60 by the swivel means 62, a C-shaped roll clip 80 is provided and is clipped onto the base of the harness 26 substantially along the length of the lower edge 64. For this purpose, it should be seen that the clip 80 has a generally hollow interior confine 82 which communicates exteriorly through a slot-like passage 84 defined by opposed side faces 86,86. The material making up the clip 80 is semi-rigid, e.g. plastic foam tubing, thereby making the opposed side faces 86,86 capable of being resiliently spread apart to allow passage of the lower edge 64 therethrough and into the larger volume confine 82. Thus the clip 80 provide a quick and low cost method of rolling the harness into a tubular form. To maintain the rolled shaped once formed, one or more securement straps 90 having ends with VELCRO attachments may either be sewn onto the material of the harness or may be simply wrapped around the roll form and be quickly removed in the instant that use of the harness 26 is needed.

In use, the lifting harness 26 is deployed by pulling the top 30 through the spacing 92 between two consecutive stanchion 60,60 in the railing and then connecting the halyard to the eyelet 36 in the top 30 of the harness. Thereafter, the top of the harness is pulled away from the remaining rolled length and is deployed in the water as shown in FIG. 1 so as to make a loop 96 which is positioned beneath the individual to be rescued. Thereafter the halyard 14 is pulled upwardly and the person enveloped by the lifting harness rolls on itself in the harness as the lifting harness is pulled upwardly until he or she is even with the deck whereupon he or she rolls through the space 92 between the stanchions 60,60 of the railing.

By the foregoing a man overboard recovering device has been disclosed. However, numerous modifications and substitutions maybe had without departing from the invention. For example, the lifting harness may be positioned amid ship at the widest beam dimension in the manner illustrated in FIG. 5 so that the top of the harness can be hoisted by the main halyard of the vessel. Also, while disclosed in combination with a sailing vessel, the lifting harness is equally adapted to be used with a power vessel with handles being located at the harness top for manual lifting. Accordingly the invention has been described by way of illustration rather than limitation.

What is claimed is:

1. A man overboard rescue device comprising:

a sheet-like lifting harness having an effective shape as defined by a top, a first foot and a second foot;

each of said first foot and said second foot including means for securing each foot to a stationary part of a vessel, and said top of said lifting harness including means for connecting the lifting harness to a halyard for moving the lifting harness top relative to said first foot and said second foot;

said lifting harness in an area associated with the top thereof being formed at least in part from a mesh-like material which is capable of passing substantially freely through water, and wherein said lifting harness is formed from a two-piece construction with a first section associated with the top thereof and a second section associated with said first foot and said second foot, with the first section including said mesh-like water permeable material and said second section being formed from a generally water impermeable material.

2. A man overboard rescue device as defined in claim 1 further characterized by said lifting harness being provided with an eyelet at each of said top and said first foot and said second foot.

3. A man overboard rescue device as defined in claim 2 further characterized in that surrounding each of said eyelets are radially extending stress dispersing strips which are secured to the material making up said lifting harness.

4. A man overboard rescue device as defined in claim 3 further characterized by said first section including indicia which is printed thereon and sized relative to the lifting harness overall length dimension with in proportion of at least 1:4.

5. A man overboard rescue device as defined in claim 4 further characterized in that said first section of said harness being defined by a material which has a fluorescent color and said indicia includes black lettering which is screen printed thereon.

6. A man overboard rescue device as defined in claim 4 further characterized by a swivel means being associated with each of said first foot and said second foot and said harness having a lower edge extending in a straight line therebetween.

7. A man overboard rescue device as defined in claim 6 further characterized by each swivel means including a swivel snap-clip having an axis of rotation and each capable of being secured to one of two space points on the deck of a vessel for effecting rotation of the lower edge of the lifting harness about the axis of rotation of each snap-clip so as to roll the lifting harness in a roll form for storage.

8. A man overboard rescue device as defined in claim 7 further characterized by said lifting harness including adjustable straps interposed between respective ones of the forward foot and aft foot and each swivel means, and securement straps which wrap around the lifting harness in roll form having VELCRO connectors thereon.

9. A man overboard rescue device as defined in claim 8 further characterized in that the first foot and second foot of the lifting harness are secured at two points on a vessel through the intermediary of said swivel means, and said two point having a free space therebetween.

10. A man overboard rescue device as defined in claim 9 further characterized by a C-shaped roll clip provided and clipped onto the lifting harness substantially along the length of the lower edge, said clip having a generally hollow interior confine which communicates exteriorly through a slot-like passage defined by opposed side faces, and the material making up the clip being semi-rigid thereby making the opposed side faces capable of being resiliently spread apart to allow passage of the lower edge therethrough and into the larger volume confine.

11. A sheet like lifting harness comprising:

two geometric sections attached together along a line transversely extending across said lifting harness to define generally a base section having a first foot and a second foot and an upper section having a top;

said base section being formed from a non-water permeable material and said upper section being formed from a mesh-like material;

said lifting harness also including a border which is attached thereabout;

said top of the lifting harness, the first foot and the second foot each having an eyelet defined by a ring associated therewith and being provided with webbing which are provided as reinforcing strips which prevent pullout of each ring secured to the lifting harness; and wherein said top section including indicia which is printed thereon and sized relative to the lifting harness overall length dimension to be readily viewable and said first section of said harness further being defined by a material which is has a fluorescent color and said indicia includes black lettering which is printed thereon.

12. A method of bringing aboard a person who is the water onto a vessel comprising the steps of:

providing a lifting harness having a generally triangular shape as defined by a top portion and two foot portions;

providing each of said foot portions with a means for securing said harness to a stationary part of a sailing vessel;

providing means for securing the top portion to a halyard for moving the harness relative to the remaining first and second foot portions;

providing said top portion with a mesh-like material which is capable of passing freely through water; and using the top portion of the lifting harness to surround the person in the water as the person is oriented alongside the vessel and pulling the person upwardly by pulling down on a halyard to roll the person over on him or herself as the halyard is pulled upwardly; and storing said lifting harness by rolling it around itself and securing it at spaced points on a deck of a vessel by providing an elongated clip member for holding the base of the lifting harness in a straight line in a coiled condition.

* * * * *